United States Patent [19]

King

[11] Patent Number: 4,693,296

[45] Date of Patent: Sep. 15, 1987

[54] COMPOSITE BREAK RING FOR CONTINUOUS CASTING

[75] Inventor: Patrick D. King, Rantoul, Ill.

[73] Assignee: Flo-Con Systems, Inc., Champaign, Ill.

[21] Appl. No.: 795,837

[22] Filed: Nov. 7, 1985

[51] Int. Cl.[4] ..... B22D 11/10

[52] U.S. Cl. ..... 164/440; 164/490

[58] Field of Search ..... 164/490, 155, 437, 440, 164/439; 222/591, 594, 597, 599, 606; 428/498; 501/97

[56] References Cited

U.S. PATENT DOCUMENTS

| | | | |
|---|---|---|---|
| 3,642,058 | 2/1972 | Webbere | 164/283 |
| 3,726,333 | 4/1973 | Goodrich | 164/82 |
| 4,044,217 | 10/1977 | Otsuki | 219/76 |
| 4,357,382 | 11/1982 | Lambert | 428/698 |

FOREIGN PATENT DOCUMENTS

| | | | |
|---|---|---|---|
| 56-11164 | 4/1981 | Japan | 164/ |

*Primary Examiner*—Nicholas P. Godici
*Assistant Examiner*—G. M. Reid
*Attorney, Agent, or Firm*—Jack E. Dominik

[57] ABSTRACT

A break ring formed by providing a frame having a cross-section complementary to the exterior portion of the break ring, and the frame having an interior base of the cross-section of the break ring which will be in contact with the molten metal in the continuous caster is disclosed. The frame is thereafter filled with plasma sprayed boron nitride, silicon nitride, or whatever material is to immediately contact the metal in the horizontal continuous caster. This is subsequently followed by the spraying of a substrate onto the skin of the break ring, whereafter the body portion is finally filled. Detonation gun-type spraying is also contemplated, but a plasma gun forms a superior coating and gives more flexibility. Finally, the body is formed interiorly of the break ring further by plasma application or by casting. In one option, a cooling tube is laid into the body portion. The break ring itself is characterized by a continuous construction with a skin preferably of boron nitride or related materials, a substrate of zirconium oxide or aluminum oxide or silicon carbide, and a body of copper or equivalent materials. Optionally the body contains a coolant tube which can be constantly flushed during the course of casting and maintain the break ring at a temperature below that of the metal being cast.

7 Claims, 7 Drawing Figures

COMPOSITE BREAK RING FOR CONTINUOUS CASTING

FIELD OF THE INVENTION

The present invention relates to horizontal continuous casters for the casting of metal, and more specifically to a composite break ring and method relating to a component of such horizontal casters.

SUMMARY OF THE INVENTION

Horizontal continuous casters have a long history, dating back to U.S. Pat. No. 3,023 issued in 1843. More recently, however, General Motors Pat. Nos. 3,642,058 and 3,726,333 exemplify an upgraded state of the art, and disclose horizontal continuous casters useful in making billets both round in cross-section and rectangular. Companies active in the field include Technica-Guss GmbH of Wurzburg, Germany; Mannesmann Demag Huttentechnik in Duisburg, Germany; and Steel Casting Engineering Limited of Orange, Calif. Critical to a horizontal continuous caster is an element known as the "break ring" which immediately precedes the mold as the metal is poured from the holding tundish. The break ring is slightly smaller than the mold and defines the meniscus in horizontal continuous casting molds and stops the crystallization front from growing toward the refractory of the tundish or slide gate preventing a shell growing problem. Most continuous casting break rings are formed of a boron nitride. They may also be formed of silicon nitride, aluminum oxide mixtures with graphite, admixtures of silicon nitride and boron and mixtures of boron and aluminum nitride.

According to the current state of the art, the break rings are formed from a block of material. Boron nitride machines readily with conventional machining equipment, but is quite expensive. Since it is a ring, the central area is sacrificed and becomes waste with little likelihood of reclaimation. Furthermore because the current state of the art break rings must be machined from a single block of material, there is a size limitation as to the dimensions of the break ring.

Particularly where one wants a break ring and a mold to mold continuous sheets from twenty-four to forty-eight inches wide, a break ring of similar cross-section (slightly less) is required. Such are not capable of production according to the current state of the art.

SUMMARY OF THE INVENTION

The present invention relates to the method of forming a break ring by providing a frame having a cross-section complementary to the exterior portion of the break ring, and the frame having an interior base of the cross-section of the break ring which will be in contact with the molten metal in the continuous caster. The frame is thereafter filled with plasma sprayed boron nitride, silicon nitride, or whatever material is to immediately contact the metal in the horizontal continuous caster. This is subsequently followed by the spraying of a substrate onto the skin of the break ring, whereafter the body portion is finally filled. Detonation gun-type spraying is also contemplated, but a plasma gun forms a superior coating and gives more flexibility. Finally, the body is formed interiorly of the break ring further by plasma application or by casting. In one option, a cooling tube is laid into the body portion. The break ring itself is characterized by a continuous construction with a skin preferably of a boron nitride or related materials, a substrate of zirconium oxide or aluminum oxide or silicon carbide, and a body of copper or equivalent materials. Optionally the body contains a coolant tube which can be constantly flushed during the course of casting and maintain the break ring at a temperature below that of the metal being cast.

It is a principle object of the present invention to provide a method for forming a break ring useful in horizontal continuous casting without waste of material, and continuous in configuration with transitions between its metallic body from material to material. The method also contemplates an alternative of burying a cooling tube within the body of the break ring. A chief advantage flowing from this method is the capability of forming a break ring of almost endless width and relatively narrow depth where slab casting is desired.

A further object of the present invention is to provide a break ring inexpensively and without waste of material, and which can be formed to a wide variety of sizes in simple frames without major tooling costs.

A further object of the present invention is to provide a method as well as a break ring which is efficient and effective in operation and gives long life, in addition to economical cost.

BRIEF DESCRIPTION OF THE DRAWINGS

Further objects and advantages of the present invention will become apparent as the following description of an illustrative embodiment proceeds, taken in conjunction with the accompanying drawings, in which.

DETAILED DESCRIPTION OF THE PREFERRED EMBODIMENTS

Figure 1:
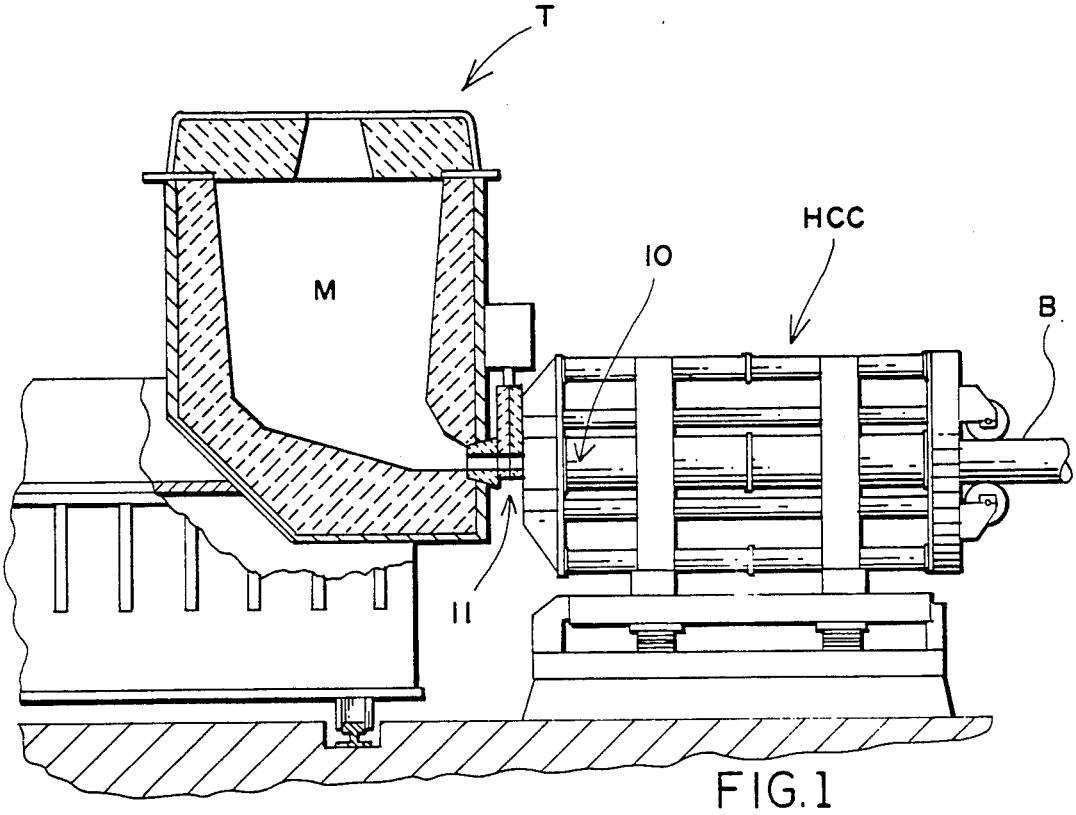
FIG. 1 is a front elevation of a horizontal continuous caster taken in longitudinal cross-section illustrating the principal element of such a caster.

The Method. The method of the present invention will be best understood in the environment in which it finds itself. Turning now to FIG. 1, it will be seen that a horizontal continuous caster HCC is provided to produce a billet B by pouring metal M from a tundish T. Unlike the vertical continuous casters, the horizontal continuous caster has a mold which does not vibrate. The horizontal continuous caster relies on a plurality of pulling elements to grasp the billet B and reciprocatingly draw the same through the mold while the mold is fed by the metal M in the tundish T.

Figure 2:
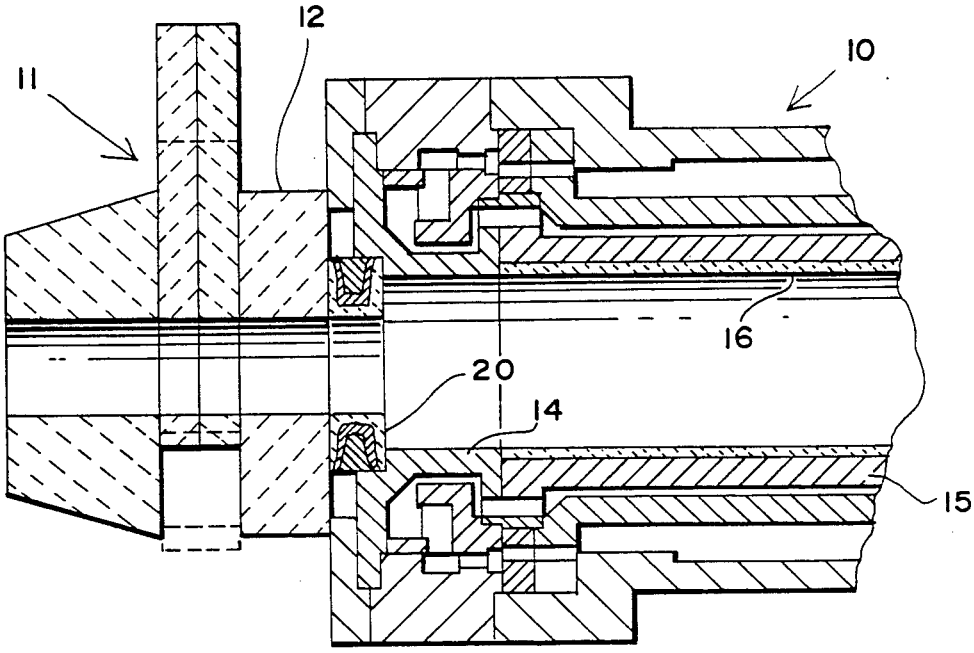
FIG. 2 is a longitudinal section of an illustrative break ring and mold construction.

Turning now to FIG. 2, it will be seen that the mold assembly 10 includes a valve 11 for shutting off the flow of metal M from the tundish T, or opening the same. When the valve 11 is open, the metal M first contacts the ring 12 which is normally a zircon silicate ring. It serves to accomplish the initial transition. The metal continues to flow through the zircon silicate ring 12 into the first mold portion 14, and thereafter to the second mold portion 15. A graphite insert 16 may be placed inside the interior portion of the copper molds 14, 15.

In accordance with the invention, a break ring 20 is provided between the zircon silicate ring 12, and the mold portions 14, 15. The function of the break ring is as set forth in the Summary, primarily to prevent crystalline growth going rearwardly into or toward the tundish, and to permit an orderly transition of the metal into the mold 15, 16. As will be specifically noted in FIG. 2, the break ring cross-section as well as that of the zircon silicate ring 12 is of lesser magnitude than that of the mold assembly itself.

Figure 3:
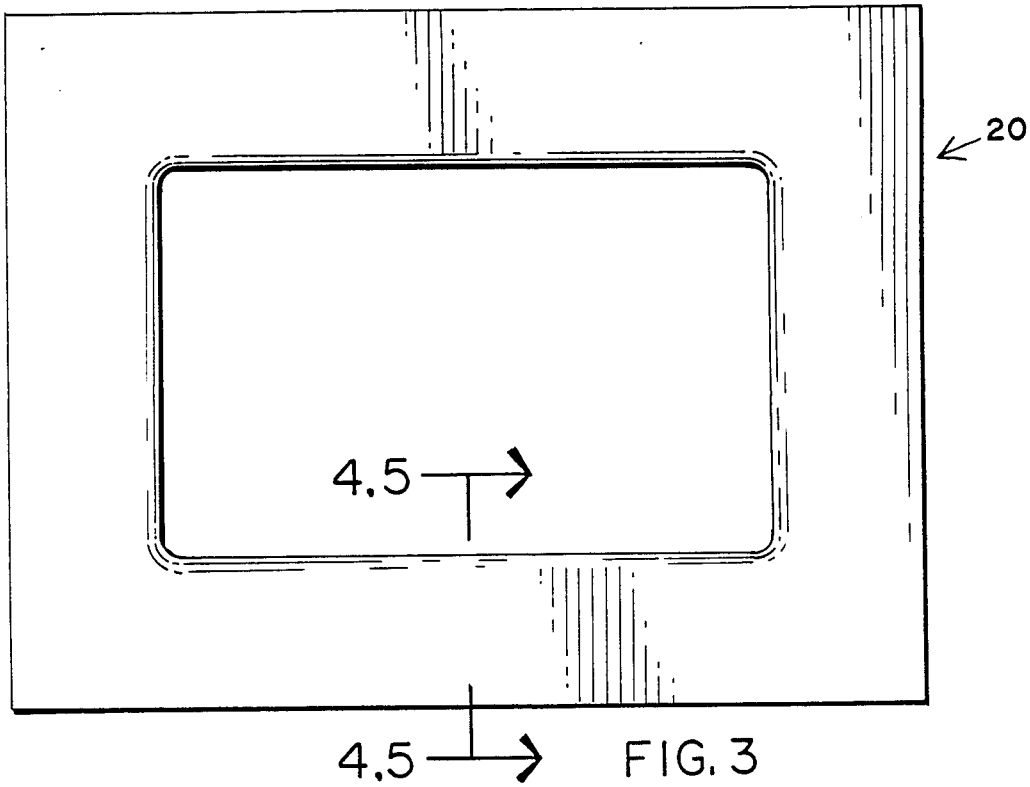
FIG. 3 is a front elevation of a typical rectangular break ring.
Figure 4:
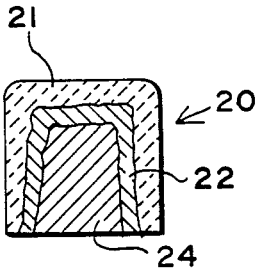
FIG. 4 is a transverse sectional view of the break ring of FIG. 3 taken along section line 4–4 of FIG. 3.
Figure 5:
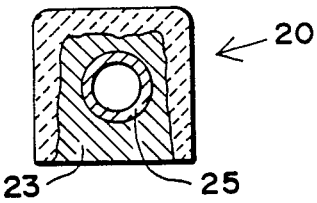
FIG. 5 is an alternative cross-section showing a coolant tube interiorly of the break ring.

Turning now to FIG. 3, it will be seen that the break ring 20 is rectangular in cross-section. As shown in FIG. 4, the break ring 20 has a boron nitride skin 21 which may be also formed of silicon nitride, or a boron nitride combination with aluminum nitride. It is formed of a sufficient depth to accommodate the wear of the break ring 20 until such time as it requires removal from the horizontal continuous caster. A second substrate 22 is formed interiorly of the break ring and may be of zirconium oxide, aluminum oxide, or silicon carbide. This skin 22 as seen in FIG. 4 forms a barrier between the outer skin and the body 24 of the break ring. The body 24 may be copper or aluminum oxide. As shown alternatively in FIG. 5, a coolant tube 25 may be burried in the body 24 to provide for continuous cooling.

Figure 7:
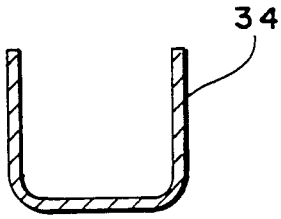
FIG. 7 is a transverse view of a frame member of the mold taken along section line 7—7 of FIG. 6.
Figure 6:
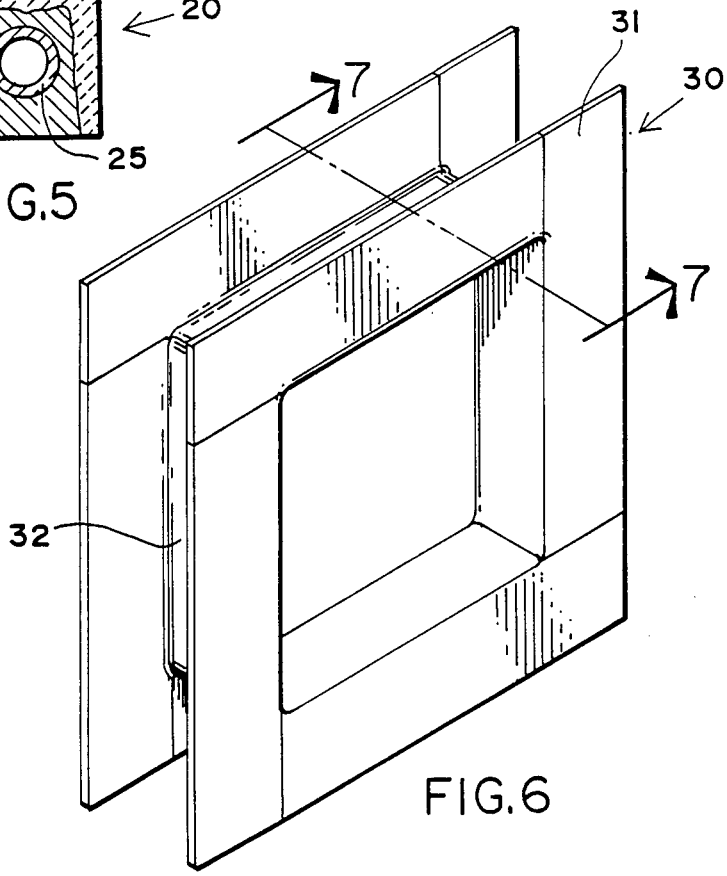
FIG. 6 is a perspective view of a mold useful in forming the break ring of FIG. 3.

The method contemplates first the formation of a mold 30 as shown in FIG. 6. The mold essentially has outlying frame plates 31, and a base 32 which forms the interior portion of the break ring 20. In accordance with the method, a plasma gun is employed to lay-up the layers of skin 21, 22 and the body 24. A detonation gun is also contemplated for the same purpose. What is important is that the break ring 20 be formed as a unitary body interiorly of the mold 30. As seen in FIG. 7, the mold cross-section 34 is generally U-shaped, and may be made from an extrusion to minimize the cost of the mold 30. The mold 30 may be disassembled at its joint portions after the break ring 20 is formed, or it may be etched away or, when formed of a metal with a lower melting point than that of the break ring 20, melted away. The dimensioning of the mold 30 is intended to accommodate any shrinkage of the break ring due to its formation, and to provide the ultimate dimensional characteristics of the particular unit. The break rings are normally press-fitted into the horizontal continuous caster.

In summary, the break ring 20 is characterized by a smooth exterior skin 21 which is endless in nature due to its formation in a single frame. A secondary skin 22 or substrate 22 separates the exterior skin 21 from the interior body 24. The interior body 24 may be cast into place or applied with a plasma gun or detination gun.

Although particular embodiments of the invention have been shown and described in full here, there is no intention to thereby limit the invention to the details of such embodiments. On the contrary, the intention is to cover all modifications, alternatives, embodiments, usages and equivalents as fall within the spirit and scope of the present invention, specification, and appended claims.

What is claimed is:

1. A break ring for use with a continuous caster comprising, in combination:

a closed loop body, said body having an interior first formed U-shaped skin on the inner portion of the loop, said skin being characterized as a sprayably deposited substance exhibiting the characteristics of a molten metal heat spray deposited outer skin, a secondary secondly formed U-shaped skin interiorly of the exterior first formed U-shaped skin formed in intimate contact with the exterior first formed skin and exhibiting the characteristics of a molten metal heat sprayed material different from the material of the exterior skin, and an interior body portion interior of the second formed U-shaped skin, said interior body portion being a formable material.

2. The break ring of claim 1, in which, a cooling tube is embedded in the body portion.

3. The break ring of claim 1, in which, the U-shaped exterior first formed skin is selected from the group including boron nitride, silicon nitride, or boron nitride-aluminum nitride.

4. The break ring of claim 1, in which, the secondary secondly formed U-shaped skin is formed of zirconium oxide.

5. The break ring of claim 1, in which, the secondary secondly formed U-shaped skin is formed of a material including one from the class including zirconium oxide, aluminum oxide, or silicon carbide.

6. The break ring of claim 1, in which, the body portion is formed of copper.

7. The break ring of claim 1, in which, the body portion is formed of aluminum oxide.

* * * * *